US009427845B2

(12) United States Patent
Boulogne et al.

(10) Patent No.: US 9,427,845 B2
(45) Date of Patent: Aug. 30, 2016

(54) METHOD FOR COMPACTING ANODIC PAINTS, INCLUDING THE COLLISION OF SANDBLASTING JETS

(71) Applicant: SNECMA, Paris (FR)

(72) Inventors: Jacques Boulogne, Thiais (FR); Alain Potel, Ballancourt (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 14/403,243

(22) PCT Filed: May 29, 2013

(86) PCT No.: PCT/FR2013/051192

§ 371 (c)(1),
(2) Date: Nov. 24, 2014

(87) PCT Pub. No.: WO2013/178941

PCT Pub. Date: Dec. 5, 2013

(65) Prior Publication Data

US 2015/0158146 A1 Jun. 11, 2015

(30) Foreign Application Priority Data

May 29, 2012 (FR) ..... 12 54921

(51) Int. Cl.

| | |
|---|---|
| ***B24C 1/10*** | (2006.01) |
| ***B24C 3/02*** | (2006.01) |
| ***C23C 4/18*** | (2006.01) |
| ***B05D 3/12*** | (2006.01) |

(52) U.S. Cl.
CPC . *B24C 1/10* (2013.01); *B05D 3/12* (2013.01); *B24C 3/02* (2013.01); *C23C 4/18* (2013.01)

(58) Field of Classification Search
CPC ..... B24C 1/10; B05D 3/12; C23C 4/18
USPC ..... 451/38; 72/53
See application file for complete search history.

(56) References Cited

U.S. PATENT DOCUMENTS

| | | | | |
|---|---|---|---|---|
| 1,654,509 | A * | 12/1927 | Claus | C23C 4/04 164/46 |
| 3,754,976 | A * | 8/1973 | Babecki | C23C 24/04 29/527.2 |
| 4,771,659 | A * | 9/1988 | Schmolke | D01G 15/88 451/40 |
| 5,035,090 | A * | 7/1991 | Szucs | B05B 7/10 239/403 |
| 5,526,664 | A * | 6/1996 | Vetter | B21D 31/06 72/53 |
| 5,592,841 | A * | 1/1997 | Champaigne | B24C 1/10 451/39 |
| 6,123,999 | A * | 9/2000 | Felix | C23C 4/04 427/449 |
| 6,604,986 | B1 * | 8/2003 | Fahnle | B24C 1/00 451/102 |
| 2011/0104991 | A1 * | 5/2011 | O'Donoghue | B24C 1/10 451/36 |
| 2011/0236192 | A1 | 9/2011 | Ferrer et al. | |

OTHER PUBLICATIONS

International Search Report Issued Jul. 22, 2013 in PCT/FR13/051192 Filed May 29, 2013.

* cited by examiner

*Primary Examiner* — Joseph J Hail
*Assistant Examiner* — Henry Hong
(74) *Attorney, Agent, or Firm* — Oblon, McClelland, Maier & Neustadt, L.L.P.

(57) ABSTRACT

A method for compacting anodic paints by sandblasting, the method including directing at least two jets of an abrasive material toward a part covered with the paint, the jets being directed in a convergent manner and meeting at a focal point, and the focal point is located upstream from the part.

7 Claims, 1 Drawing Sheet

METHOD FOR COMPACTING ANODIC PAINTS, INCLUDING THE COLLISION OF SANDBLASTING JETS

BACKGROUND OF THE INVENTION

1. Field of the Invention

The field of the present invention is that of the surface treatment of mechanical components and, in particular, that of the compaction of anodic paints for protecting turbo machine components.

2. Description of the Related Art

Certain aircraft engine components are very heavily mechanically loaded and only special-purpose materials are able to meet the mechanical integrity requirements imposed upon them. These materials in general have the disadvantage of being very sensitive to corrosion; it is therefore absolutely essential to protect them with a product capable of withstanding the environment in which these components move (high temperature, presence of engine oil, kerosene, etc. . . . ). The anticorrosion protection currently used involves covering the component with a paint that is resistant to high temperatures and to the aforementioned various fluids. However, because this paint is classified as CMR (carcinogenic, mutagenic, reprotoxic), it is hit by the REACH regulations regarding the registration, evaluation, authorization and restriction of chemicals. It has therefore become necessary to look for a new method of protection in order to get around the constraints associated with these regulations.

A first solution is to base the protective system not on the mere principle of covering with a paint but on a physicochemical process referred to as anodic paint. This process consists in spraying onto the surface of the component a liquid which is laden with metallic pigments, such as aluminum or zinc pigments, then in heating the component in a furnace to polymerize the sprayed product. This results in a tough protective layer which protects against oxidation as long as it is not scorched, but which has the property of not being conducting. As soon as the component becomes scratched or scorched, the protection ceases, the component becoming sensitive to electrochemical corrosion. In order to guard against this risk, the surface layer needs to be made conductive in order to create a sacrificial layer which will corrode for preference, in place of the metal of the component that is to be protected.

The expression anodic paint is then used to denote the superficial layer thus rendered conducting. In order to achieve that, the metallic particles incorporated into the formulation of the paint need to be orientated through a mechanical action after polymerization, without impairing the cosmetic appearance thereof. There are two methods commonly used to that end:

burnishing, which involves rubbing the painted parts after polymerization in the same direction, using a metallic sponge. This action makes it possible to achieve electrical continuity on the treated parts. By contrast, this is a manual action which is difficult to automate and cannot therefore be employed on an industrial scale, and one in which there is a not-insignificant risk that component regions that are difficult to access will not be treated.

compaction, which involves sand-blasting the painted parts after polymerization. This action makes it possible to achieve electrical continuity on the treated parts. However, it has to be performed at very low pressure in order not to impair the treated zones. By contrast, in order to keep the sand-blasting installation operating correctly, it needs to maintain a relatively high service pressure and, in any case, a service pressure that is too high for treating the component; in the current state of affairs, that results in the quality of the coating obtained being systematically impaired.

It is therefore necessary to find a method that allows the compaction of anodic paints using sand-blasting that respects the quality of the coating of the treated components.

BRIEF SUMMARY OF THE INVENTION

To that end, the subject of the invention is a method of compacting anodic paints using sand-blasting involving directing at least two jets of an abrasive material toward a component covered with said paint, said jets being oriented convergently and meeting at a focal point, characterized in that said focal point is positioned upstream of the component.

By focusing the two jets of sand before they reach the component, the impingement of sand particles on one another causes the jets to lose some of their energy and makes them able to be used for an operation of compacting an anodic paint.

For preference, the arrangement of the jets of abrasive material exhibits symmetry with respect to the direction perpendicular to the surface that is to be treated.

In one particular embodiment, there are two of the jets of abrasive material, making an angle of 90° between them.

For preference, the distance of the focal point back from the surface of the component that is to be treated is comprised between 200 and 300 mm.

Advantageously, the sand-blasting pressure is higher than 2 bar. Existing sand-blasting installations can therefore be used, simply by moving the sand-blasting nozzles back.

BRIEF DESCRIPTION OF THE SEVERAL VIEWS OF THE DRAWINGS

The invention will be better understood and other objects, details, features and advantages thereof will become more clearly apparent during the detailed explanatory description which follows, of one embodiment of the invention given purely by way of non-limiting illustrative example with reference to the attached schematic drawings.

In these drawings.

DETAILED DESCRIPTION OF THE INVENTION

Figure 1:
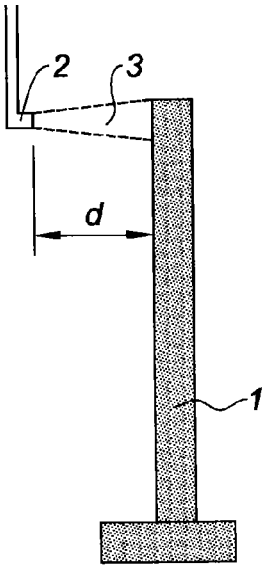
FIG. 1 is a face-on schematic view of a device for sand-blasting a component according to the prior art, according to one embodiment of the invention.
Figure 2:
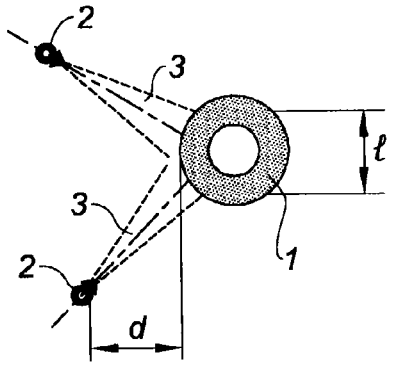
FIG. 2 is a schematic view from above of a device for sand-blasting a component according to the prior art.

FIGS. 1 and 2 respectively show a face-on view and a view from above of the sand-blasting of a component 1 as commonly used for creating the surface finish of a turbo machine component. Conventional sand-blasting is performed using two nozzles 2, oriented at 90° to one another and each directing a beam of sand 3 at right angles to the surface of the component 1, the two jets spreading in the same plane. The distance "d" of the straight line connecting the two nozzles 2 to the component 1 is such that the two beams 3 meet at a focal point 4 which is situated on the component 1, i.e. that they both reach the same point that is to be sandblasted.

In order to perform the sand-blasting, the two nozzles are moved simultaneously along the component 1, over the height and circumference thereof, at all times maintaining the same geometry in terms of the relative position of the nozzles 2 and of the surface of the component 1. Taking into consideration the solid angle that characterizes the divergence of the beams 3, the area swept by the sand-blasting at each moment has the shape of a circle of diameter "l".

Figure 3:
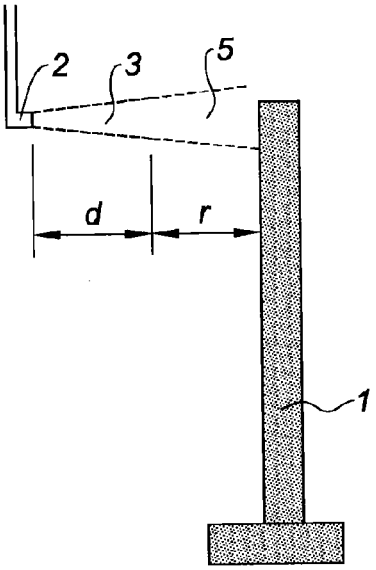
FIG. 3 is a face-on schematic view of a device for sand-blasting a component according to one embodiment of the invention.
Figure 4:
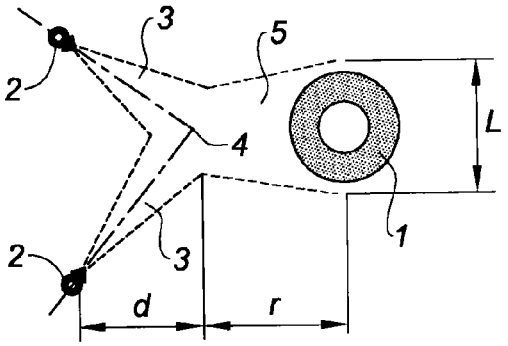
FIG. 4 is a schematic view from above of a device for sand-blasting a component according to one embodiment of the invention.

Referring now to FIGS. 3 and 4, these respectively show a face-on view and a view from above of the compaction according to the invention of the paint covering the component that is to be treated. The two nozzles 2 are positioned as before with jets 3 oriented in the same plane at 90° to one another and with the same solid angle of divergence. Once again, the sweep along the component is performed in the same way as for conventional sand-blasting. By contrast, the distance at which the nozzles are situated away from the surface of the component is increased by comparison with the previous instance, so that the straight line connecting them now lies at a distance greater than the focusing distance d. Added to this distance is a nozzle setback distance "r" which means that the jets of sand meet at a focal point 4 which this time is situated forward of the surface of the component. The impinging of the two jets against one another leads to a phenomenon of diffraction of these jets, which combine into a single jet, with a larger solid angle. This diffracted jet is oriented at right angles to the wall that is to be treated because of the given symmetry of the layout of the jets with respect to the direction perpendicular to the surface of the component 1. As a result, the size of the area swept at each instant by the compaction is greater and forms a circle of diameter "L" which is greater than "l".

The principle of operation of a compaction of anodic paint according to the invention will now be described.

In conventional sand-blasting with two nozzles at 90°, the nozzles/component distance is set so that the focal point 4 of the jet lies on the surface of the component that is to be treated 1, i.e. where the kinetic energy of the sand is the greatest. The sand-blasting pressures used are commonly of the order of 3 bar. The focal length d is invariable, whatever the sand-blasting pressures employed.

In order to perform the desired compaction, it is possible to conceive of reducing the sand-blasting pressure down to around 1.5 bar, which corresponds to the minimum pressure value that the installations will tolerate. However, even this reduced pressure is too great for compaction because it would damage the treated surfaces through a phenomenon of flaking of the paint. It has therefore been necessary to find a solution for reducing the power of the sand-blasting jet.

The invention consists in increasing the nozzles/component distance without changing the 90° angle of incidence of the beams of sand relative to one another. The focal point 4 of these beams thus no longer lies at the component itself, but at a point of convergence where the jets of sand intersect. The impingement of the particles therefore causes the beam to diffract, and this has the effect of reducing the velocity of the particles of sand on the component 1 thus reducing its kinetic energy and making the diffracted beam 5 lose some power. The consequence of this is that the cosmetic integrity of the paint is preserved while at the same time making the paint electrically conducting.

Moving the nozzles 2 away from the component 1 means that the jet of sand can be kept at a sufficient pressure for good installation operation. Moreover, this solution offers the advantage, because of the greater divergence of the diffracted beam 5, of covering a larger area of the component and therefore of being able to increase the rate of sweep, thus shortening the treatment cycle.

An optimization of the focal point/component distance has been researched, so that the sand-blasting pressure is high enough to ensure good compaction but not so high as to damage the treated surfaces. The invention therefore recommends a setback distance "r" via which the component is set back from the focal point of the order of 250 mm, and in any event comprised between 200 and 300 mm.

This solution makes it possible to observe all of the paint compaction requirements with perfect process repeatability and affords an appreciable time saving as the component can be swept 2 to 3 times more quickly than manual burnishing, depending on the shape of the component being treated.

The invention claimed is:

1. A method for covering a component with an anodic paint comprising:

spraying a liquid onto a surface of the component, the liquid being laden with metallic pigments;

polymerizing the sprayed liquid in order to obtain a protective layer on the component; and compacting the protective layer in order to obtain an anodic paint layer by sand-blasting involving directing at least two jets of sand toward the component, the jets being oriented convergently and meeting at a focal point, wherein the focal point is positioned upstream of the component such that the paint is not damaged and its cosmetic integrity is preserved.

2. The compaction method as claimed in claim 1, wherein an arrangement of the jets of abrasive material exhibits symmetry with respect to a direction perpendicular to a surface that is to be treated.

3. The compaction method as claimed in claim 2, wherein there are two of the jets of abrasive material, making an angle of 90° between them.

4. The compaction method as claimed in claim 1, wherein a distance of the focal point back from a surface of the component that is to be treated is between 200 and 300 mm.

5. The compaction method as claimed in claim 4, wherein a sand-blasting pressure is higher than 2 bar.

6. The compaction method as claimed in claim 1, wherein a width of a diffracted beam of sand formed by the jets of sand converging and meeting the focal point is greater than a width of the component.

7. The compaction method as claimed in claim 1, wherein a velocity of the sand impacting the component is less than a velocity of the sand upstream of the focal point.

* * * * *